US005974633A

United States Patent [19]

Sartor et al.

[11] Patent Number: 5,974,633

[45] Date of Patent: Nov. 2, 1999

[54] LEVER FASTENING DEVICE

[75] Inventors: Mariano Sartor, Montebelluna; Massimo Bettio, Quinto Di Treviso, both of Italy

[73] Assignee: Dolomite S.p.A., Treviso, Italy

[21] Appl. No.: 09/016,944

[22] Filed: Feb. 2, 1998

[51] Int. Cl.[6] ..... A43C 11/00

[52] U.S. Cl. ..... 24/71 SK; 24/68 SK; 24/70 SK

[58] Field of Search ..... 24/71 SK, 70 SK, 24/69 SK, 68 SK

[56] References Cited

U.S. PATENT DOCUMENTS

| | | | |
|---|---|---|---|
| 4,470,175 | 9/1984 | Chiarella | 24/70 SK |
| 4,541,147 | 9/1985 | Olivieri | 24/70 SK |
| 4,651,392 | 3/1987 | Olivieri | 24/71 SK |
| 5,715,582 | 2/1998 | Zorzi | 24/71 SK |

FOREIGN PATENT DOCUMENTS

| | | |
|---|---|---|
| 0186197 | 7/1986 | European Pat. Off. . |
| 2427071 | 5/1979 | France . |

*Primary Examiner*—Victor N. Sakran
*Attorney, Agent, or Firm*—Sughrue, Mion, Zinn, Macpeak & Seas, PLLC

[57] ABSTRACT

A lever fastening device comprises a lever articulated to a base about a first axis and formed in two adjoining portions of which the first has one of its ends articulated to the base on the first axis whereas the second portion is articulated to the opposite end of the first portion about a second axis; a tie element is connected to the second portion in a position spaced from the second axis on the opposite side to the first axis.

8 Claims, 4 Drawing Sheets

LEVER FASTENING DEVICE

BACKGROUND OF THE INVENTION

The subject of the present invention is a lever fastening device according to the preamble to the main claim.

Fastening devices or, in short, "fastenings", of this type are used widely in the field of sports equipment and footwear such as ski boots, snow-board shoes and bindings, and skating boots, for adjustably tightening onto one another two portions of the footwear (or equipment), such as two flaps of the upper.

These fastenings are used mainly for fastening plastics shells or cuffs of boots where, owing to the presence of levers, these fastenings can overcome the resistance offered to the closure of the flaps of the upper by the fairly stiff nature of the material used.

However, the use of conventional lever fastenings involves problems of two kinds which the invention proposes to overcome.

In the first place, the operation of the levers still requires considerable effort during both the opening and the closure of the fastening; this effort is not always in proportion to the user's muscles, particularly in the case of women and children.

In the second place, these levers can be manoeuvred only between a fully-open position and a fully-closed position. In the fully-open position, they project from the shell of the footwear like flags, hampering the user's movements; in the fully-closed position they lock the user's foot down hard so as to produce conditions which are not always comfortable, particularly when the user is not performing any sporting activity but, more simply is taking a rest or a break.

The problem upon which the present invention is based is that of the provision of a fastening device which is designed structurally and functionally so as to overcome all of the problems complained of with reference to the prior art mentioned.

SUMMARY OF THE INVENTION

This problem is solved by the invention by a fastening device of the type indicated at the beginning, characterized in that the lever comprises at least a first and a second portion adjoining one another, one end of the first portion being articulated to the base on the first axis, the second portion being articulated to the opposite end of the first portion about a second axis and constituting an operating appendage of the lever, and the tie element being connected to the second portion in a position spaced from the second axis on the opposite side to the first axis.

With a lever composed of two adjacent portions articulated to one another, and with a tie element connected to the second of these portions, the movement of the lever between the closed and open positions can thus be performed in two stages in the first of which only one of the lever portions is pivoted to the open (or closed) condition bringing about limited slackening (or tightening) of the fastening tension, and in the second of which the other portion is also pivoted open (or closed) enabling the fastening to be opened (or closed) fully.

The tie element advantageously comprises two adjoining sections articulated to one another, the first section having one of its ends connected to the second lever portion and its opposite end guided on the first lever portion, and the second section being connected to the opposite end of the first section, as an extension thereof.

BRIEF DESCRIPTION OF THE DRAWINGS

The characteristics and advantages of the invention will become clearer from the following detailed description of two preferred embodiments thereof, described by way of non-limiting example with reference to the appended drawings, in which.

DETAILED DESCRIPTION OF THE INVENTION

Figure 1:
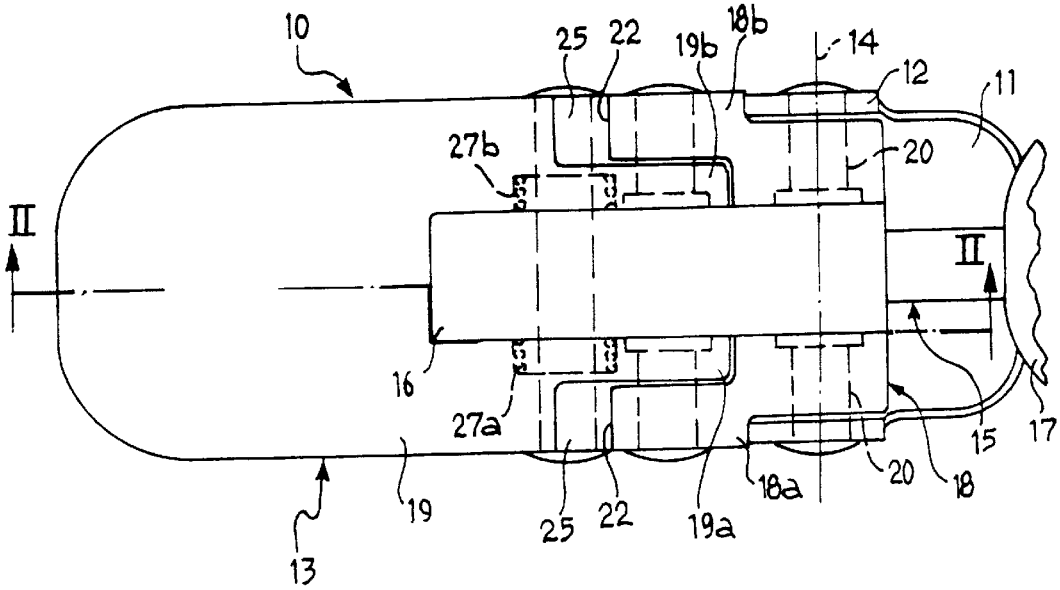
FIG. 1 is a plan view of a first embodiment of the fastening of the invention.

In FIGS. 1 to 4, a lever fastening device formed in accordance with the present invention is generally indicated 10. This device is intended to be fixed to a flap 1 of the footwear and is complementary to a rack-like device 2 which can be fixed to the other flap 3 of the footwear, as will be described further below.

The device 10 comprises a generally plate-shaped base 11 bearing two perforated lugs 12 which extend in the same direction and between which a lever 13 is articulated for pivoting about a first axis 14. The base 11 is fixed to the flap 1 by means of rivets or other equivalent devices.

One end 16 of a tie element 15 is articulated to the lever 13 and its opposite, free end carries engagement means 17 of known type for the engagement of the tie element in an adjustable position along the rack 2.

The lever 13 comprises first and second adjoining portions 18, 19. The first portion 18 is articulated by one of its ends to the base 11 so as to be pivotable about the first axis 14 constituting the main fulcrum of the lever 13. This portion is generally fork-shaped with two specularly symmetrical, generally "S" -shaped prongs 18*a*, 18*b* joined together and spaced apart by a cross-member 18*c*. Alternatively, the prongs may be in the form of two independent small connecting rods. One end of each prong 18*a*, 18*b* is articulated to the corresponding lug 12 of the base 11 by means of a respective pin 20 and its opposite, free end has two shoulders 21, 22 diverging towards the axis 14.

The second portion 19 is also fork-shaped with prongs 19*a*, 19*b* housed between the prongs 18*a*, 18*b* of the first portion 16, to which it is articulated for pivoting about a second axis 23. The second portion 19 is generally longer than the first portion 18. It constitutes the operating appendage of the lever 13.

The end 16 of the tie element 15 is articulated between the prongs 19*a*, 19*b* of the second lever portion 19 about a third axis 24. In a first embodiment of the invention, the distance between the first and second axes 14, 23 is greater than the distance between the second and the third axes 23, 24 so that the ratio between the lever arms is more favourable during the closure of the second lever portion onto the first relatively to the closure of the first lever portion onto the base. However it has been considered and in some circumstances it has been noted more favourable that the distance between the first and second axes 14, 23 be less or equal than the distance between the second and the third axes 23, 24. As matter of fact the distance between the first and second axes must be the least possible compatibly with the material incumbrance of the parts of the lever because, with this embodiment, during closure of the fastening device, one can make it jointed so as to pivote the lever about the second axis 14, starting from the open position of FIG. 4 by means of simple pressure of the second portion 19 toward the base 11 in order to let it get the position shown in FIG. 3.

Figure 2:
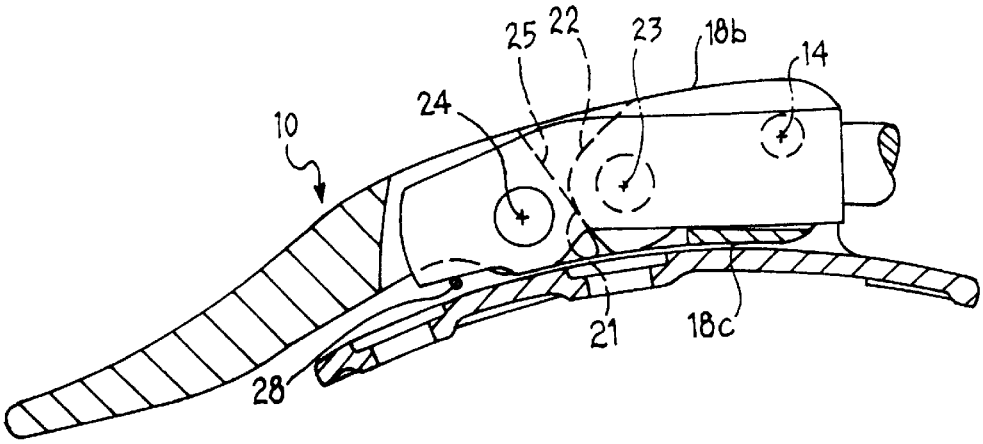
FIGS. 2 and 3 are sections taken on the line II—II of FIG. 1 with the lever in two different operative positions.
Figure 3:
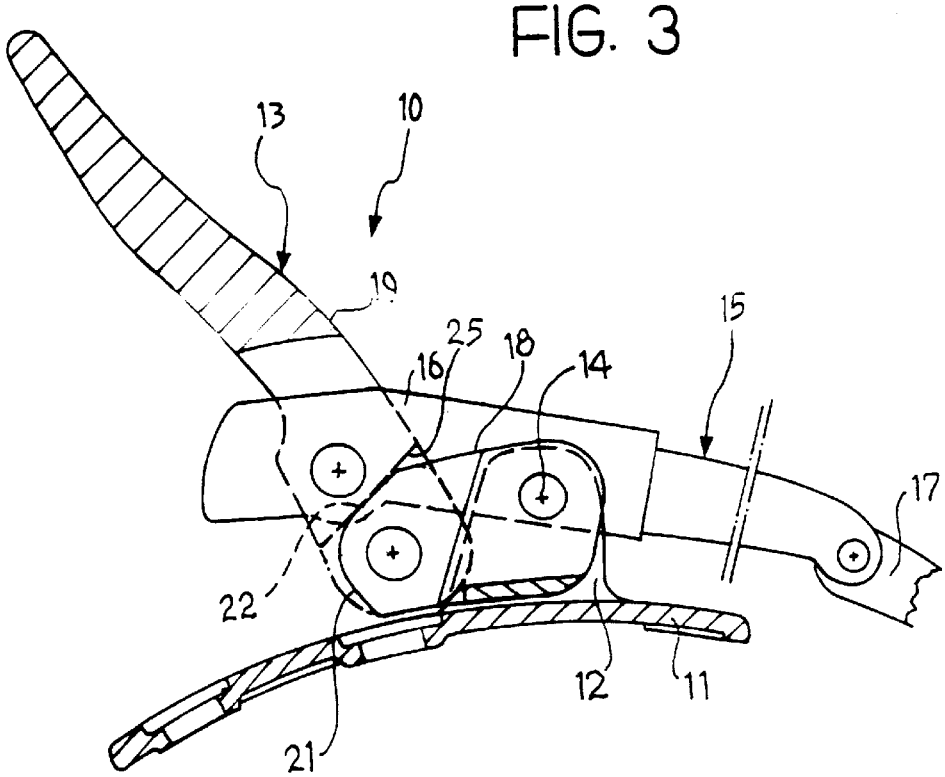
Figure 4:
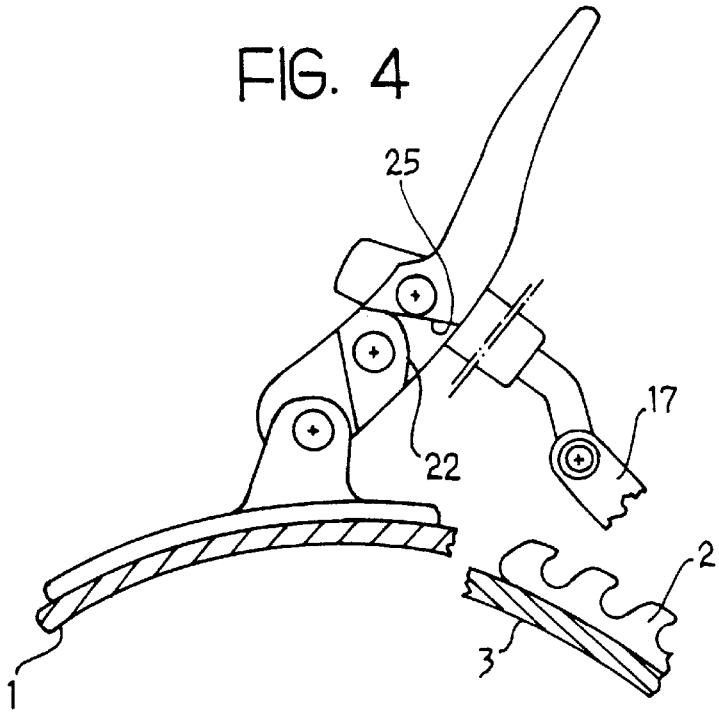
FIG. 4 is a side elevational view of the lever of the preceding drawings in the fully-open position.
Figure 5:
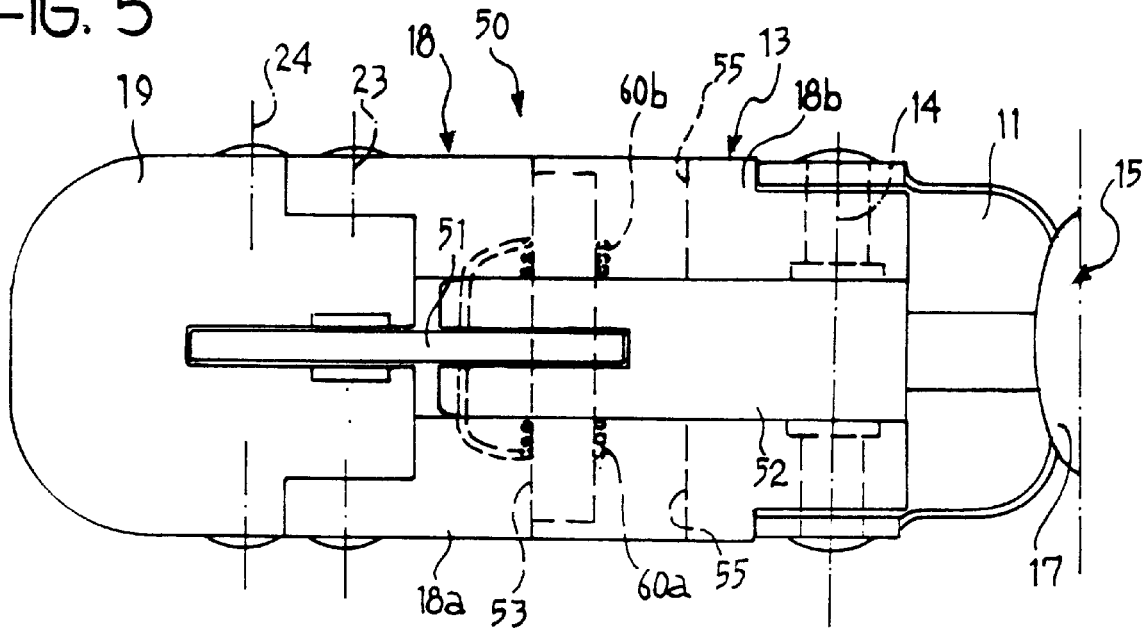
FIGS. 5 to 8 are views corresponding to those of FIGS. 1 to 4, relating to a second embodiment of the lever of the invention.

Beside each prong l9*a* 19*b* of the second lever portion is a corresponding opposite shoulder 25 which can abut the shoulders 21, 22 of the first portion 18 in the operative positions of FIGS. 2 and 3, respectively.

These shoulders and opposite shoulders constitute travel-limit means for angularly limiting the relative pivoting between the two portions of the lever 13 between the respective fully-pivoted positions shown in the two drawings indicated above. It can be seen that, in order to move from one of these positions to the other, the third axis is passed over a dead point corresponding to its passage through the plane in which the first and second axes lie. Both of the positions indicated in FIGS. 2 and 3 thus represent theoretical stable-equilibrium positions for the fastening device of the invention.

Furthermore it has to be noted that the second portion 19 of the lever 13, at its end where it is articulated for pivoting about the second axis, is round shaped (FIG. 3) or so shaped as to be rotatable relatively to the first portion up to the end-of-travel position of FIG. 3 without any interference of said end of the second portion 19 with the surface of the base 11 in such a way that the stable-equilibrium condition of the first lever 18 abutting against the base 11 may be altered.

Finally, springing is provided and comprises a double helical spring with windings 27*a*, 27*b* which are coaxial with the pin constituting the third axis 24 and are connected by a bridge 28 extending beneath the free end 16 of the tie element 15 between this end and the base.

The spring 27*a*, 27*b* acts between the tie element 15 and the lever portion 19, acting resiliently on these elements so as to urge the tie element 15 towards the rack 2. Due to the resilient action, the end portion 16 of the tie element 15 is normally urged to abut against the cross member 18*c* and the shoulder 25 of the second lever portion 19 is normally abutted against the shoulder 21 of the first portion 18, in the position of FIG. 2.

A second embodiment, generally indicated 50, of the fastening device according to the invention is described with reference to FIGS. 5 to 8.

The device 50 also comprises a base 11, a lever 13 articulated thereon about a first axis 14, and a tie element 15.

The lever 13 is also composed of two portions 18, 19 approximately similar in shape to those of the previous embodiment the description of which should be referred to for all further identical or technically equivalent details.

Unlike the first embodiment, the tie element 15 in this embodiment is composed of two adjacent sections 51, 52. One end of the first section 51 is connected to the second lever portion 19 on the third axis 24 and its opposite end is guided on the first lever portion by means of a pin 53 which connects the sections 51, 52 of the tie element and the opposite, free ends of which are housed in corresponding longitudinally elongate slots 55 in each prong 18*a*, 18*b*. As indicated above, one end of the second section 52 of the tie element is connected to the first section 51 as an extension thereof and its opposite end carries means 17 for engagement on the rack 2.

In this case, the limited permissible travel of the pin 54 in the slots 55 constitutes travel-limit means for angularly limiting the relative pivoting between the lever portions. Moreover, in this embodiment, the travel-limit means also comprise a shoulder 56 and an opposite shoulder 57 which are disposed on the first and second lever portions 18, 19, respectively, and which are in abutment with one another in the operative condition of FIG. 6.

Figure 6:
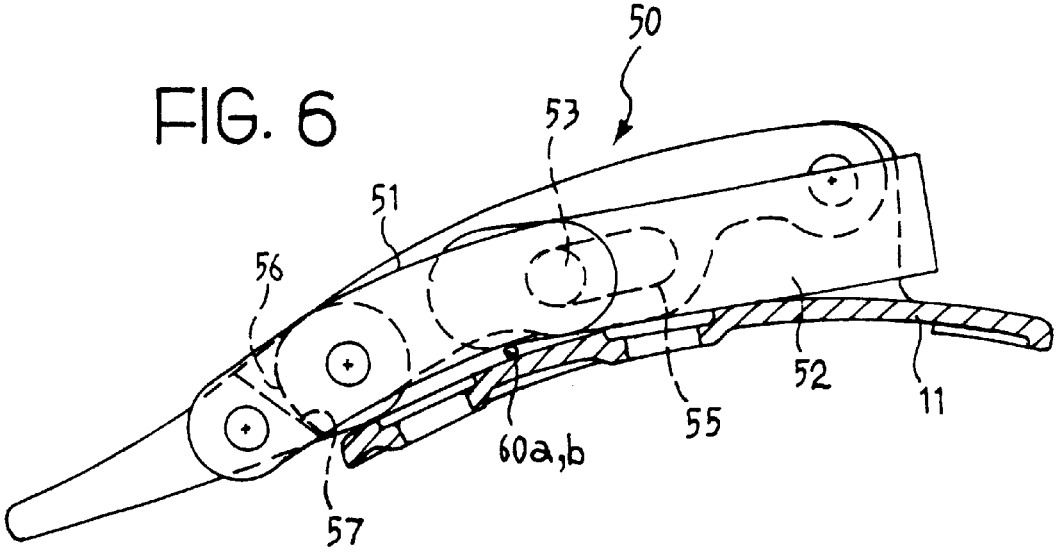
Figure 7:
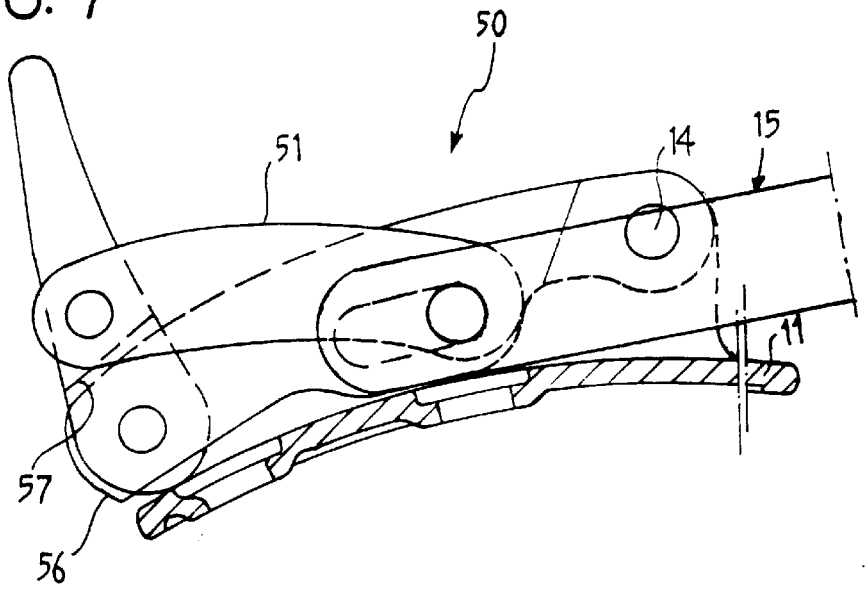
Figure 8:
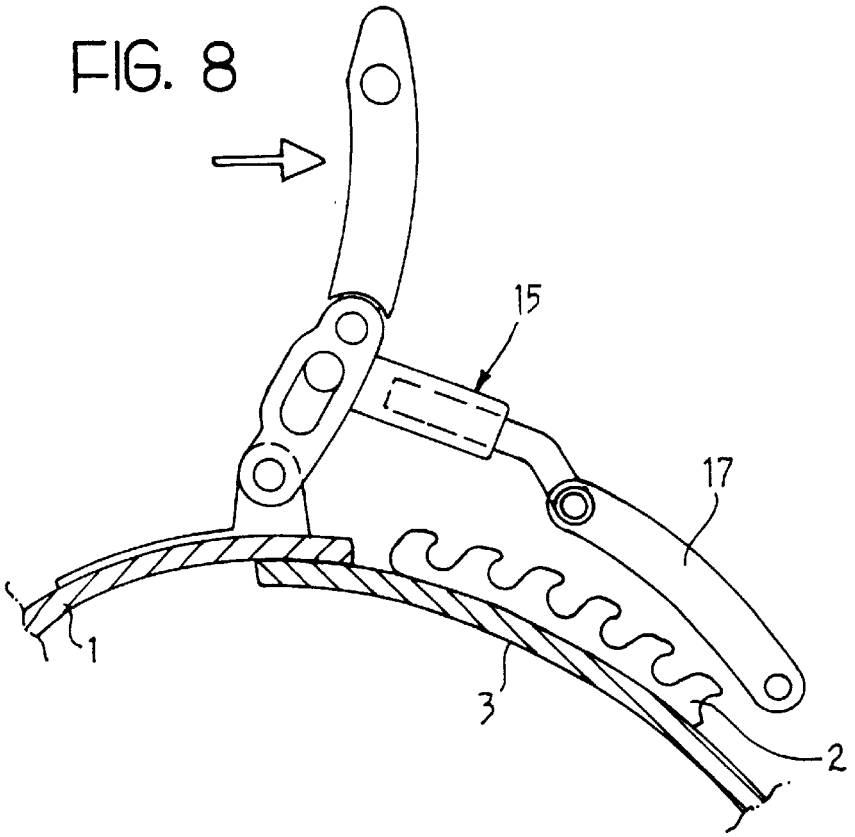

In this embodiment, in order to move from one of the positions of FIGS. 6 and 7 to the other, the third axis is also passed over a dead point corresponding to its passage through the plane in which the first and second axes lie. Both of the positions indicated in FIGS. 6 and 7 thus represent stable-equilibrium positions of the fastening device. Springing comprising a double helical spring 60*a*, 60*b* is provided between the tie element 15 and the first lever portion 18 and has similar functions to those of the springing 27*a*, 27*b* of the previous embodiment.

The invention thus solves the problem set and achieves many advantages in comparison with the prior art mentioned. For example, the opening and closure effort is reduced as a result of improved efficiency of the lever effect. Moreover, by virtue of the double lever structure with two portions, the point at which the tie element is articulated to the lever (the third axis) can be spaced considerably from the axis of the articulation of the lever to the base; this permits greater travel of the engagement means fixed to the tie element than can be achieved with conventional levers for a given pivoting movement of the lever without, however, involving an unacceptable increase in effort on the lever. The lever advantageously has an intermediate position which represents a compact stable-equilibrium position between the fully-open and fully-closed conditions. Not the least advantage is that, given the small effort required, the lever arm can be shortened in comparison with conventional levers for a given functional capacity.

What is claimed is:

1. A lever fastening device comprising:

a lever articulated to a base about a first axis, and a tie element associated with the lever, characterized in that the lever comprises at least a first and a second portion adjoining one another, one end of the first portion being articulated to the base on the first axis, the second portion being articulated to the opposite end of the first portion about a second axis and constituting an operating appendage of the lever, either for rotating said lever portions relatively to each other or for the comprehensive rotation of said lever about the first axis, said second portion having an end portion adjacent said second axis, said end portion being shaped to prevent engagement of said end portion with said base to maintain said first portion closely adjacent said base during rotation of said second portion about said second axis relative to said first portion, and the tie element being connected to the second portion in a position spaced from the second axis on the opposite side to the first axis.

2. A device according to claim 1, in which the tie element comprises two adjoining sections articulated to one another, the first section having one of its ends connected to the second lever portion and its opposite end guided on the first lever portion, the second section being connected to the opposite end of the first section, as an extension thereof.

3. A device according to claim 2, in which the tie element is substantially rigid at least in the section which is articulated to the second lever portion.

4. A device according to claim 1, in which the tie element is articulated to the second lever portion about a third axis, the distance between the first and second axes being greater than the distance between the second and third axes.

5. A device according to claim 1, in which travel-limit means are provided between the tie element and/or the lever portions for angularly limiting the relative pivoting between the lever portions in both directions of rotation for opening and closing said lever.

6. A device according to claim 5, in which the travel-limit means comprise first and second shoulders on one of the lever portions and a respective opposite shoulder on the other of the lever portions, each shoulder abutting the opposite shoulder in one of the respective angular limit positions of the relative pivoting.

7. A device according to claims 5, in which the travel-limit means comprise at least one longitudinally elongate slot in the first lever portion and a corresponding pin associated with the sections of the tie element portions and slidable in the slot in limited manner between the opposite ends thereof.

8. A device according to claim 7, in which the pin and the at least one slot constitute guide means for the said opposite end of the first section of the tie element.

* * * * *